US005907989A

United States Patent [19]

Sie et al.

[11] Patent Number: 5,907,989

[45] Date of Patent: Jun. 1, 1999

[54] FOOD SLICING RACK DEVICES

[75] Inventors: Bradley Dean Sie, Mondovi; Jeffry Allan Madson; Maryjo Rose Cohen, both of Eau Claire, all of Wis.

[73] Assignee: National Presto Industries, Inc., Eau Claire, Wis.

[21] Appl. No.: 08/979,206

[22] Filed: Nov. 26, 1997

Related U.S. Application Data

[63] Continuation of application No. 08/657,954, Jun. 4, 1996, abandoned, which is a continuation of application No. 08/241,623, May 12, 1994, Pat. No. 5,598,759.

[51] Int. Cl.[6] ..... B26D 1/10

[52] U.S. Cl. ..... 83/762; 83/454; 83/932; 83/522.11; 116/200; 269/289 R; D7/673

[58] Field of Search ..... 83/761, 762, 932, 83/454, 455, 522.11

[56] References Cited

U.S. PATENT DOCUMENTS

| | | | |
|---|---|---|---|
| D. 135,413 | 4/1943 | De Long . | |
| 179,934 | 7/1876 | Merwin . | |
| D. 253,329 | 11/1979 | Latham . | |
| 280,796 | 7/1883 | Chapman | 83/762 |
| 318,694 | 5/1885 | Chapman | 83/762 |
| D. 332,031 | 12/1992 | Haupt . | |
| D. 362,374 | 9/1995 | Roach . | |
| 471,198 | 3/1892 | Sevey | 83/762 |
| 1,072,450 | 9/1913 | Hamblin . | |
| 1,076,882 | 10/1913 | Golden . | |
| 1,307,397 | 6/1919 | Garlock . | |
| 1,822,581 | 9/1931 | Brown . | |
| 1,866,960 | 7/1932 | Zimmer . | |
| 2,172,538 | 9/1939 | Katzinger . | |
| 2,398,192 | 4/1946 | Scheminger, Jr. . | |
| 3,058,503 | 10/1962 | Perakis . | |
| 3,915,309 | 10/1975 | Brazdo . | |
| 4,085,642 | 4/1978 | Birmingham . | |
| 4,125,046 | 11/1978 | Kroh et al. . | |
| 4,204,451 | 5/1980 | Reichert . | |
| 4,249,445 | 2/1981 | Browning . | |

(List continued on next page.)

FOREIGN PATENT DOCUMENTS

| | | |
|---|---|---|
| 80 24617 | 11/1980 | France . |
| 3408382 A1 | 9/1985 | Germany . |
| 366852 | 2/1932 | United Kingdom . |
| 2 172 494 | 9/1986 | United Kingdom . |

OTHER PUBLICATIONS

Haupt Enterprises Instruction Sheet for Slice 'n' Easy Bread Slicing Guide.

Copy of Haupt Enterprises, Sunnyvale, CA product literature for "Slice 'n' Easy®, The Bread Slicing Guide," one page.

(List continued on next page.)

*Primary Examiner*—M. Rachuba

*Attorney, Agent, or Firm*—Merchant, Gould, Smith, Edell, Welter & Schmidt, P.A.

[57] ABSTRACT

A food slicing rack device includes a base with a top surface and two rows of spaced apart fingers defining knife guide slots extending from the base. A backstop is provided at one end of the device. The top surface of the device slopes downwardly in a direction from an open end of the device toward the backstop. Electric knife rivet recesses are provided for removing the knife after cutting. A snap arrangement is provided to snap the knife to the device for storage. The fingers are provided with alternating colors to facilitate alignment of the guide slots and uniform cutting. A hand slot in the backstop is provided for removing the sliced food item from the device. One construction provides for separate U-shaped members joined together to form the device. Methods of slicing food include tilting the food item toward a backstop and slicing each successive slice in a direction toward the backstop, withdrawing the knife through enlarged recesses provided in the cutting fingers, swiping the hand through a slot in the backstop to remove the sliced items, and attaching the knife to the rack device upon the completion of the cutting operation.

22 Claims, 6 Drawing Sheets

U.S. PATENT DOCUMENTS

| | | | |
|---|---|---|---|
| 4,447,051 | 5/1984 | Price . | |
| 4,589,206 | 5/1986 | Marcoux . | |
| 4,599,928 | 7/1986 | Oker . | |
| 4,638,561 | 1/1987 | Koike . | |
| 4,648,300 | 3/1987 | Hassenfelt, Jr. | 83/762 |
| 4,756,519 | 7/1988 | Lilja . | |
| 4,846,692 | 7/1989 | Delcambre | 434/159 |
| 4,856,398 | 8/1989 | Kruse et al. . | |
| 4,930,759 | 6/1990 | Potter et al. . | |
| 4,946,323 | 8/1990 | Kazama et al. . | |
| 4,964,323 | 10/1990 | Fortney . | |
| 5,090,286 | 2/1992 | Ward . | |
| 5,115,704 | 5/1992 | Hyman . | |
| 5,181,439 | 12/1993 | Schwartz . | |
| 5,287,784 | 2/1994 | Brockett . | |
| 5,383,384 | 1/1995 | Dennis | 83/762 |
| 5,386,755 | 2/1995 | Schneider et al. . | |

OTHER PUBLICATIONS

Copy of Haupt Enterprises, Sunnyvale, CA instruction sheet for Slice 'n' Easy®, The Bread Slicing Guide, one page.

Photos of a DAK slicing product, four pages.

Copy of instructions for a DAK slicing product, three pages.

Copy of Perfect Slices product literature, one page.

Document entitled "Tru–Cut Bread Miter," four pages.

Copy of a Farberware® document entitled "Today's Best Name in Homebaked Bread Storage," one page.

FOOD SLICING RACK DEVICES

This is a continuation of application Ser. No. 08/657,954, filed Jun. 4, 1996, now abandoned, which is a continuation of application Ser. No. 08/241,623, filed May 12, 1994 now U.S. Pat. No. 5,598,759.

FIELD OF THE INVENTION

The present invention relates to devices and methods for slicing bread and other food items.

BACKGROUND OF THE INVENTION

Various food slicing devices are known with multiple guide slots including, for example, U.S. Pat. Nos. 4,964,323; 4,125,046; 4,085,642; 3,058,503; 1,822,581; and D332,031. U.S. Pat. No. 4,964,323 in particular concerns a bread cutting apparatus having bread-supporting rails 8, a pair of slicing guides 15 and a backstop 10. A knife 18 can be inserted into aligned slits 16 of guides 15 and operation of the knife will slice the loaf.

Various concerns exist with the above-noted devices and other devices for slicing food, such as bread, including ease of manufacture of the device, and ease of use of the device. The ability to produce uniform and aesthetically pleasing slices of the food item is also a concern. Another concern is the location and placement of the cut slices after they are removed from the remainder of the food item, i.e., whether they are conveniently stored and easy to access. Another concern is providing the device with an aesthetically pleasing appearance for storage on a kitchen countertop or tabletop. Another concern is whether the device is compact during storage.

There is a need in the art for devices and methods which address at least some of the above concerns or other concerns in the area of food slicing.

SUMMARY OF THE INVENTION

The present invention relates to food slicing rack devices including a base with a top surface, and two rows of aligned, spaced apart guide fingers defining knife guide slots extending from the base wherein the two rows of guide fingers are spaced from each other to receive a food item for slicing on the top surface of the base between the two rows of guide fingers in a cutting chamber. The guide fingers guide the knife during the cutting operation. One aspect of the invention relates to providing the food slicing rack device with a backstop adjacent to a first end of each row of guide fingers. A second end of each row of guide fingers defines an open end of the rack device wherein the top surface of the base slopes downwardly in a direction from the open end toward the backstop when the rack device is positioned on a horizontal surface.

Another aspect of the invention relates to providing each row of guide fingers with an electric knife rivet recess adjacent to an end of each finger near the base to permit an electric knife to be removed from between adjacent guide fingers in a direction transverse to direction of extension of the guide fingers after the food item is sliced.

A further aspect of the invention relates to a knife holder for preferably snap fitting attachment of an electric knife to the food slicing rack device for storage.

Another aspect of the invention relates to providing adjacent guide fingers in each row of guide fingers with different visual indicators to permit ease of alignment of the knife guide slots and the knife during use. Preferably, the visual indicators include different colors or other indicia and/or different structural configurations. In one embodiment, the base and the two rows of guide fingers are constructed from separate U-shaped members constructed of alternating colored plastic material and joined together to form the food slicing rack device. In another embodiment, the guide fingers are provided with different relative heights.

A further aspect of the invention relates to constructing the food slicing rack device of separate U-shaped members to form the base and the two rows of spaced-apart guide fingers wherein the separate U-shaped members are held together by an elongated rod member, such as a bolt, or other attachment structure. Preferably, a tongue-and-groove interface or other interlocking interface is provided at the base of each U-shaped member to facilitate alignment and attachment. Preferably, at least two of the U-shaped members are provided with support legs for spacing the base of the rack device at a spaced-apart distance from a horizontal surface. More preferably, one U-shaped member is provided with legs having a longer length than another other U-shaped member with legs wherein the rack device is provided with a tilted configuration relative to a horizontal surface. Preferably, the U-shaped member with the longer legs is also provided with a snap arrangement for releasably holding an electric knife, and a cord clip for holding the cord of the electric knife.

An additional aspect of the invention relates to a hand slot in the backstop of the food slicing rack device wherein ease of removal of the cut slices, and any remaining portion of the food item, is facilitated.

The invention also relates to methods of slicing food, such as bread, wherein the food item is positioned in a food slicing rack device on a top surface angled downward toward a backstop relative to a horizontal surface. The method also preferably includes withdrawing an electric knife from the food slicing rack device in a direction transverse to the direction of extension of the guide fingers wherein the rivet of the electric knife passes through a knife rivet recess. The method further preferably includes snap fitting the electric knife to the food slicing rack device for storage. The method also preferably includes swiping a hand through the food slicing rack device through a slot in the backstop to remove the sliced items, and any unsliced portion. The preferred method further includes a method of assembly wherein separate U-shaped members, preferably of alternating colors, are attached to one another to define the top surface and the spaced apart rows of guide fingers on either side of the top surface.

BRIEF DESCRIPTION OF THE DRAWINGS

In the drawings, like reference numerals generally indicate corresponding parts throughout these several views.

DETAILED DESCRIPTION OF THE PREFERRED EMBODIMENTS

Figure 1:
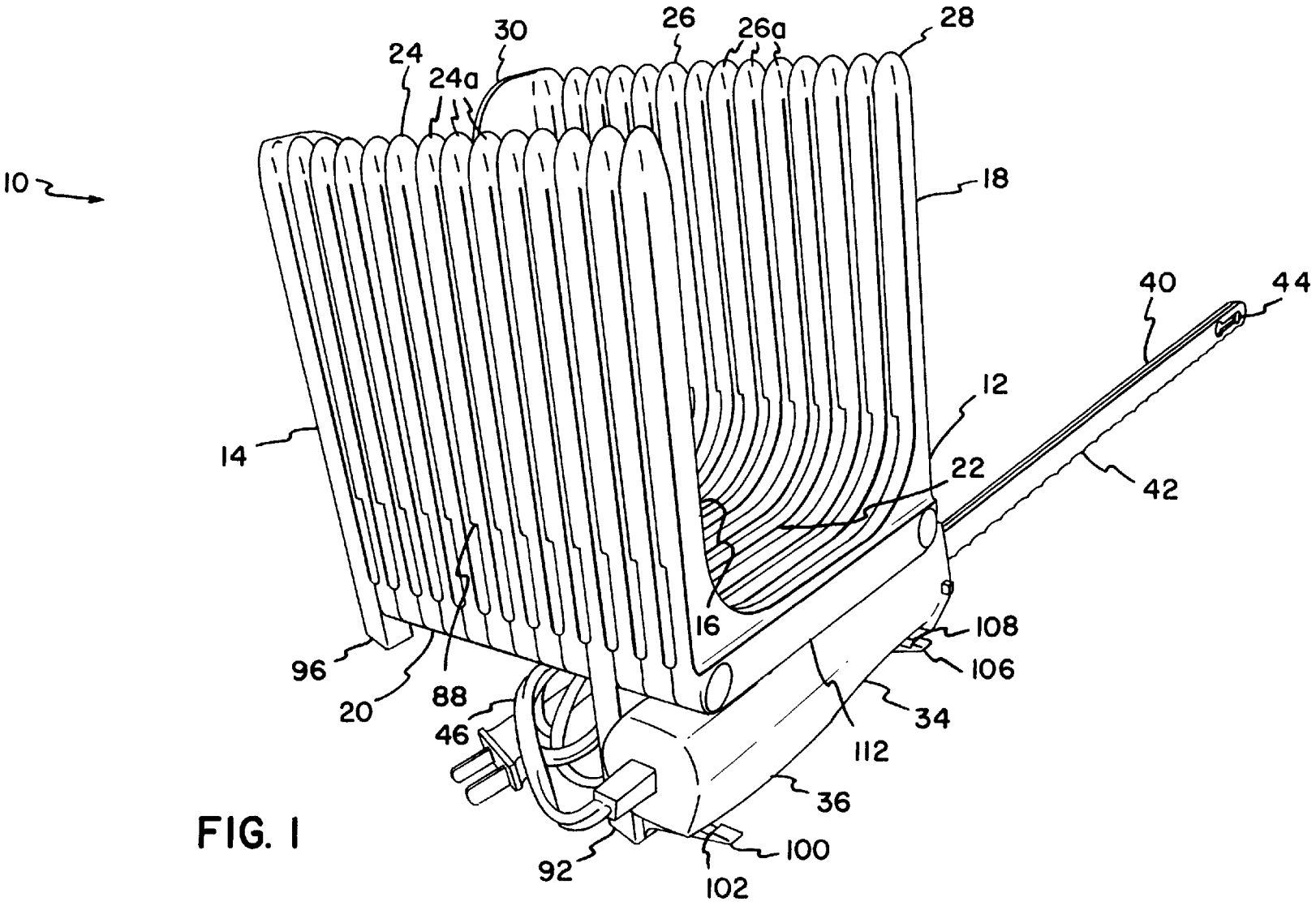
FIG. 1 is a perspective view of a preferred embodiment of a food slicing rack device according to the present invention, showing the top, left side, and front portions of the rack device, including an electric knife mounted to the rack device.

Referring now to FIG. 1, an embodiment of a food slicing rack device, or rack device 10, is shown for use in slicing food items, such as unsliced bread, including homemade bread, or other unsliced food item. Rack device 10 includes a front portion 12, a rear portion 14, a left side portion 16, and a right side portion 18. Rack device 10 generally includes a base 20 having a top surface 22 and two rows 24, 26 of spaced apart guide fingers 24*a*, 26*a* defining guide slots for receipt of a knife blade to slice a food item positioned on top surface 22 between rows 24, 26 of spaced apart guide fingers 24*a*, 26*a*. Each of the fingers 24*a*, 26*a* includes a tapered tip 28 for ease of positioning of the knife blade in the guide slot during use. Rack device 10 further includes a backstop 30 wherein the food item is positionable against backstop 30 during use.

Figure 3:
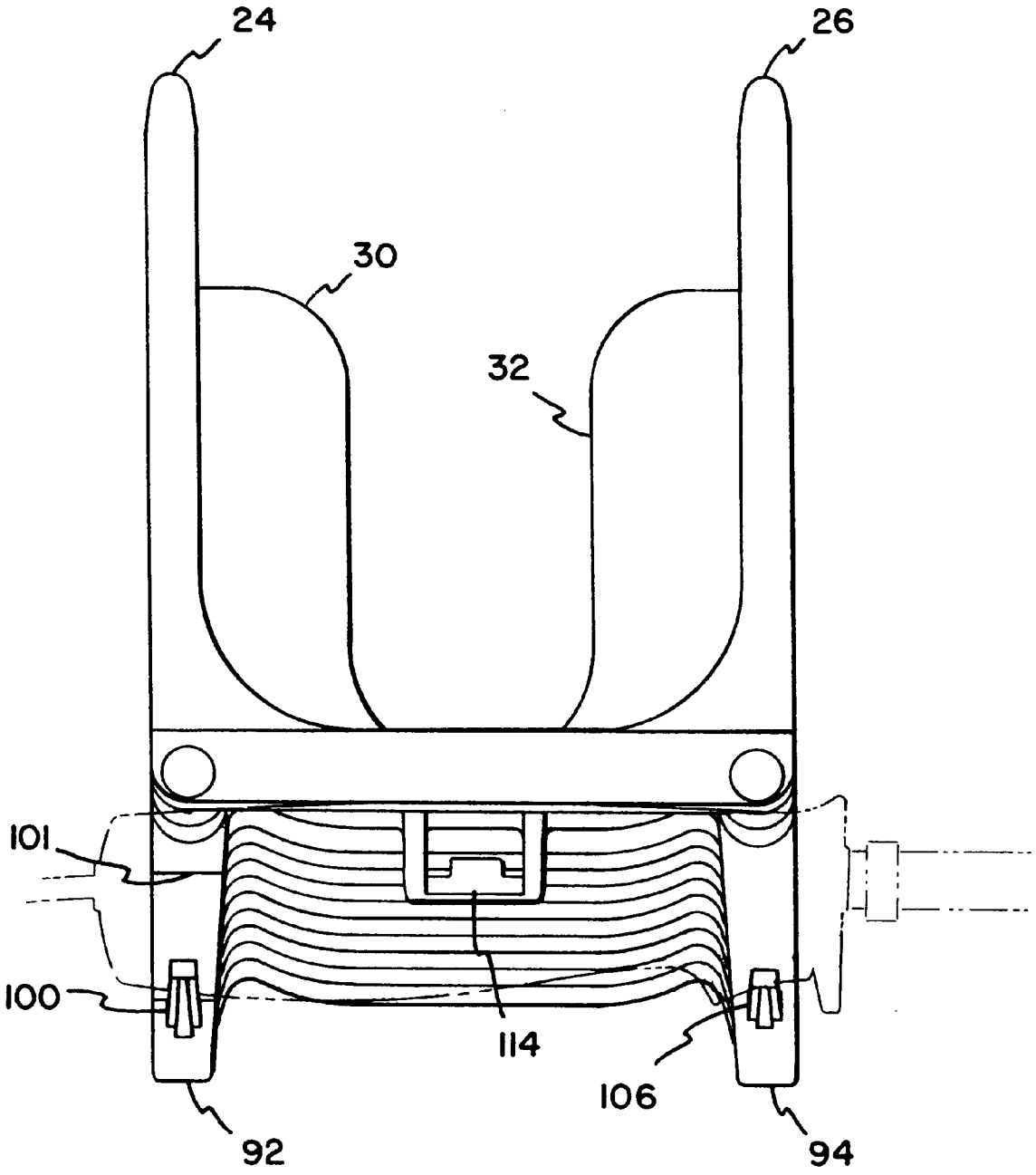
FIG. 3 is a front elevational view of the rack device of FIG. 1, including the electric knife shown in phantom lines.
Figure 4:
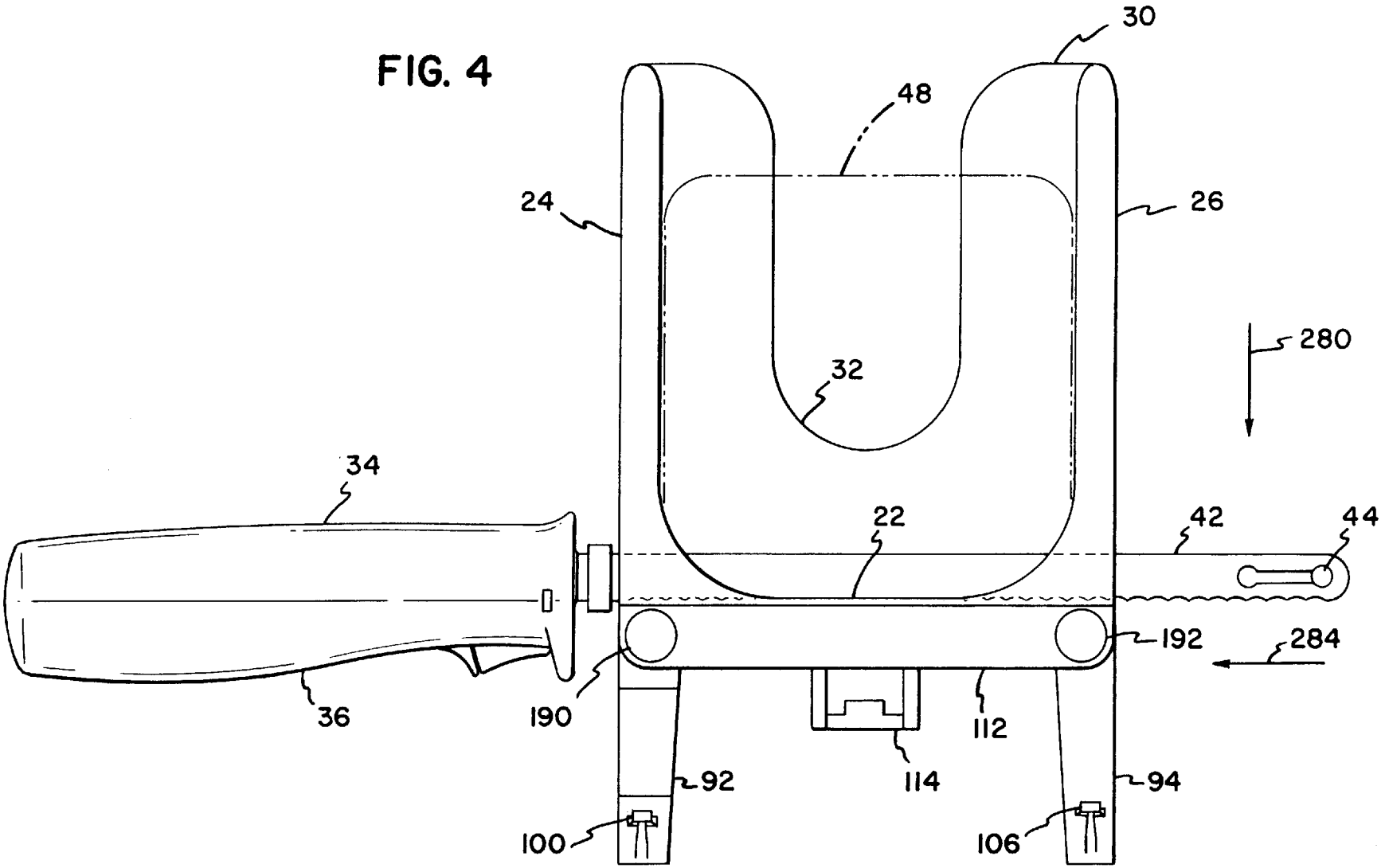
FIG. 4 is a front view of the rack device wherein the line of sight is parallel to the top surface of the base of the rack device of FIG. 1, and including the electric knife shown during the slicing operation.

As best shown in FIGS. 3 and 4, backstop 30 includes a slot 32 for receiving the hand of an operator to remove the sliced food item and any remaining portion of the food item from the cutting chamber defined by top surface 22 and rows 24, 26 of guide fingers 24*a*, 26*a*.

Figure 2:
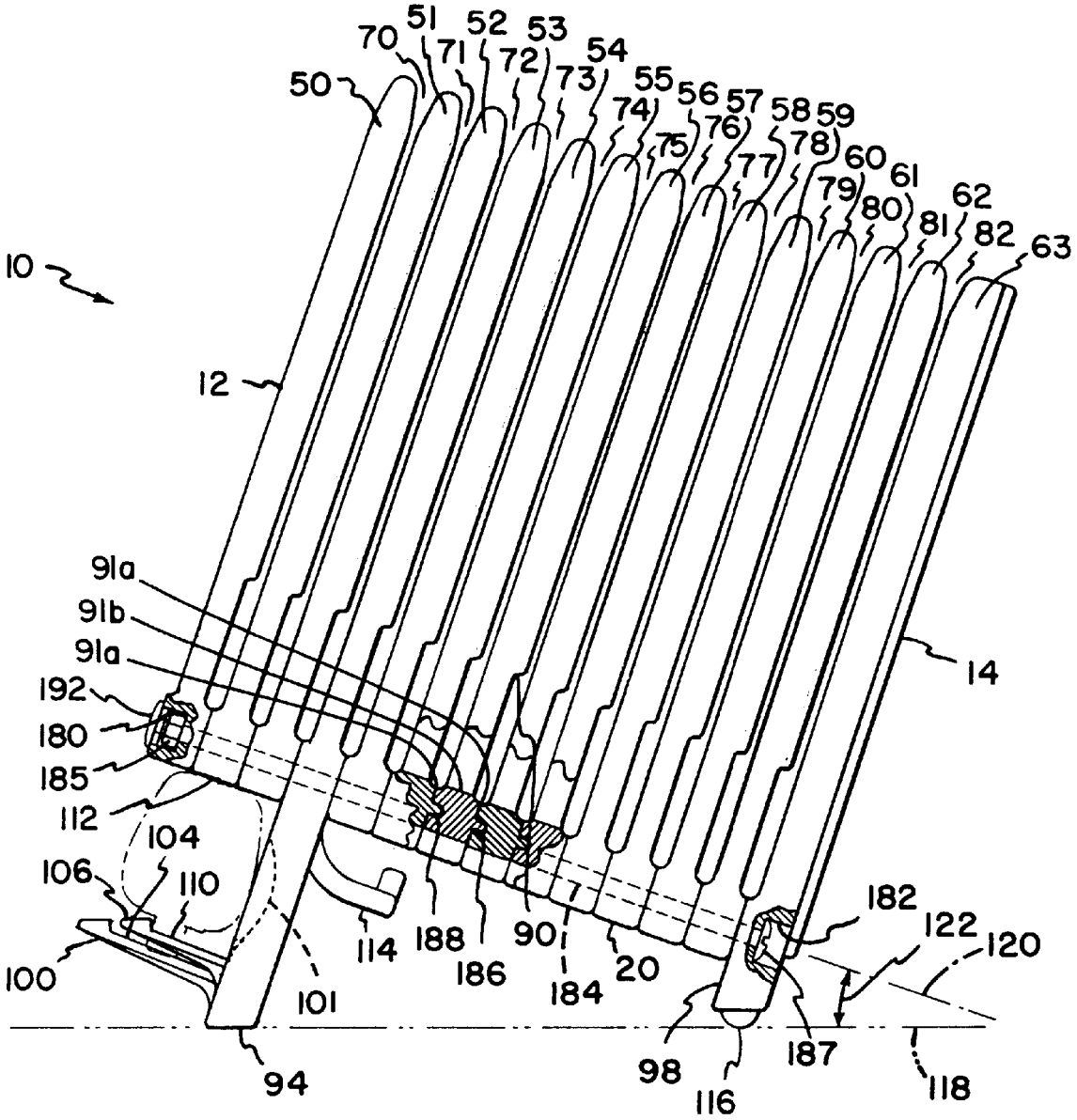
FIG. 2 is a right side elevational view of the rack device of FIG. 1, including the electric knife shown in phantom lines.

Referring now to FIGS. 1–3, rack device 10 is shown with an electric knife 34 mounted to rack device 10 in a storage position. Knife 34 includes a body 36, two alternately reciprocating knife blades 40, 42, and a connecting rivet 44. Power cord 46 extending from body 36 is also mounted to rack device 10 for convenient storage as shown in FIG. 1. Body 36 includes a motor for reciprocating knife blades 40,42 during use.

During the cutting operation, knife 34 is used to cut a loaf of bread 48 as shown in FIG. 4. As will be discussed below, knife 34 is moved downwardly in a direction of arrow 280 to cut a slice from a remainder of loaf of bread 48. Then, knife 34 is pulled toward the operator in the direction of arrow 284 to remove knife blades 40, 42 from rack device 10. This process is repeated to cut another slice if desired. It is to be appreciated that a conventional single blade knife could be used to slice loaf of bread 48. In that case, the operator manually applies a sawing motion with the conventional knife blade.

Base 22 and rows 24, 26 of spaced apart guide fingers 24*a*, 26*a* are shown in FIGS. 1–6 as being constructed from separate U-shaped members 50, 51, 52, 53, 54, 55, 56, 57, 58, 59, 60, 61, 62, 63 joined together in the preferred embodiment. Above top surface 22 is a guide slot 70, 71, 72, 73, 74, 75, 76, 77, 78, 79, 80, 81, 82 between adjacent U-shaped members 50–63 in each row 24, 26 of fingers. As shown in FIGS. 1 and 2, each guide slot 70–82 includes an enlarged rivet recess adjacent to top surface 22. For example, slot 76 between U-shaped members 56, 57 includes a first rivet recess 88 on left side portion 16, and a second rivet recess 90 on right side portion 18 of rack device 10. Rivet recesses 88, 90 are enlarged slots relative to the spacing of the rest of the fingers to permit rivet 44 of knife 34 to pass in a direction transverse to the direction of extension of rows 24, 26 of fingers 24*a*, 26*a* when knife 34 is removed after cutting a slice, as in the direction of arrow 284 of FIG. 4. The closer spacing of fingers 24*a*, 26*a* above recesses 88, 90 permits more uniform slicing. Grooves 91*a* are provided at the bottom of the guide slots as shown in FIG. 2. Between grooves 91*a* are raised portions 91*b* as also shown in FIG. 2.

As shown in FIGS. 1–4, U-shaped member 53 adjacent to front portion 12 of rack device 10 includes first and second long legs 92, 94 for supporting rack device 10. U-shaped member 63 adjacent to rear portion 14 of rack device 10 includes first and second short legs 96, 98 for supporting rack device 10 and facilitate a tiltback arrangement of top surface 22 in a direction toward backstop 30. As shown in FIG. 2, line 120 is parallel to top surface 22 of FIGS. 1 and 4. Line 120 is at an angle relative to horizontal surface 118, such as a tabletop. The angle between line 120 and horizontal surface 118 is represented by angle 122, and in the preferred embodiment is about 20 degrees. The tiltback configuration retains the cut slices in the cutting chamber of rack device 10 such that each newly cut slice rests against the uncut remainder, and any unremoved slices previously cut remain next to each other. The cut slices remain in a convenient stack such that no slice falls out of the rack device onto the tabletop. It is to be appreciated that other angles of top surface 22 besides 20 degrees are possible for retaining the cut slices.

Back support legs 96, 98 include a rubber stop 116 for resisting sliding forces applied to rack device 10 during use.

As shown in FIG. 1, knife 34 is mounted to rack device 10 for storage. Extending from first long leg 92 is a first knife clip 100. Extending from second long leg 94 is a second knife clip 106. First knife clip 100 includes a shoulder 102 and a recess 104 for receiving a first portion of body 36 of knife 34 as shown in FIGS. 1 and 3. Second knife clip 106 includes a shoulder 108 and a recess 110 for receiving a second portion of body 36 of knife 34 as shown in FIGS. 1 through 3. First long leg 92 may also include a recess 101 for receiving a portion of body 36. Body 36 of knife 34 is therefore trapped by a snap arrangement to rack device 10 within a chamber defined by knife clips 100, 106, first and second long legs 92, 94, and bottom surface 112 of base 20. It is to be appreciated that knife 34 can be mounted to rack device 10 with other holder arrangements not utilizing snaps, where body 36 of knife 34 is held to rack device 10 for storage with other structures, such as a mechanical latch, or with gravity in a recess.

Extending from U-shaped member 53 is a cord clip 114 best shown in FIGS. 2 through 4. Cord clip 114 provides a convenient hook for holding a portion of cord 46 of knife 34 during storage.

U-shaped members 50–63 are preferably separate members held together by any convenient structure. One preferred structure is a rod member such as bolt 184 on opposites of each U-shaped member, and in general alignment with the rows 24, 26 of spaced apart fingers. Caps 190, 192 cover nuts 185. As shown in FIG. 2, nut 185 resides in a recess 180, preferably hexagonally shaped. Head 187 of bolt 184 resides in a recess 182 in U-shaped member 63. Bolt 184 threadably mounts to nut 185 to hold U-shaped members 50–63 together.

Figure 6:
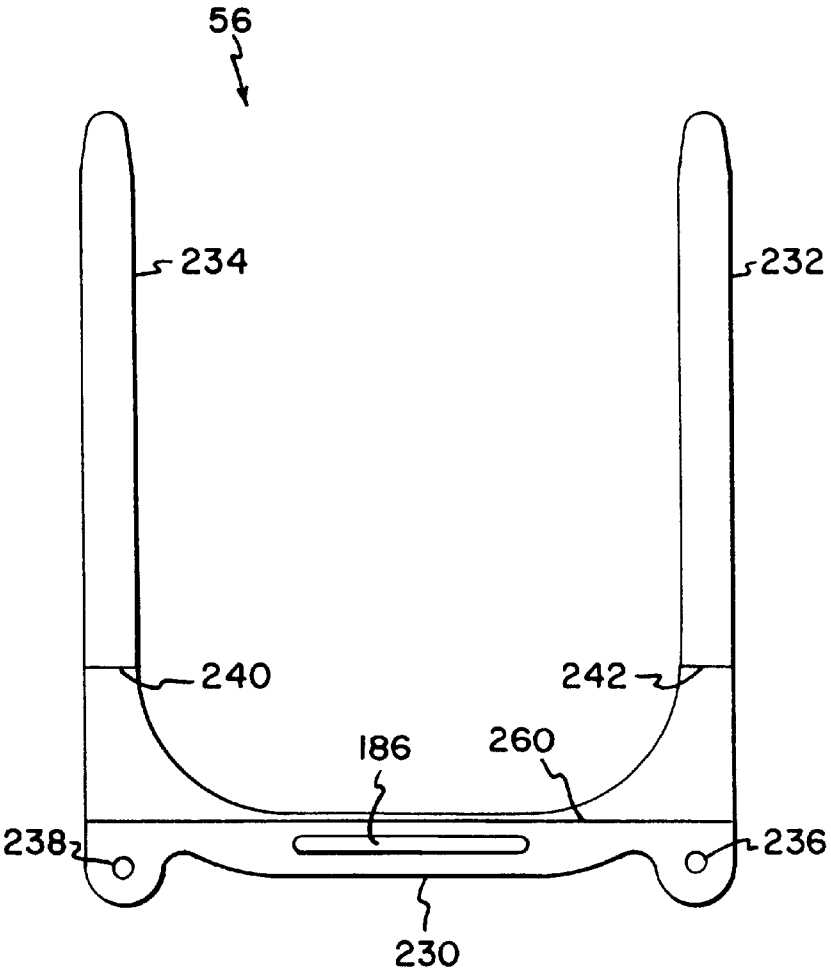
FIG. 6 is a back view of the U-shaped member of FIG. 5.
Figure 5:
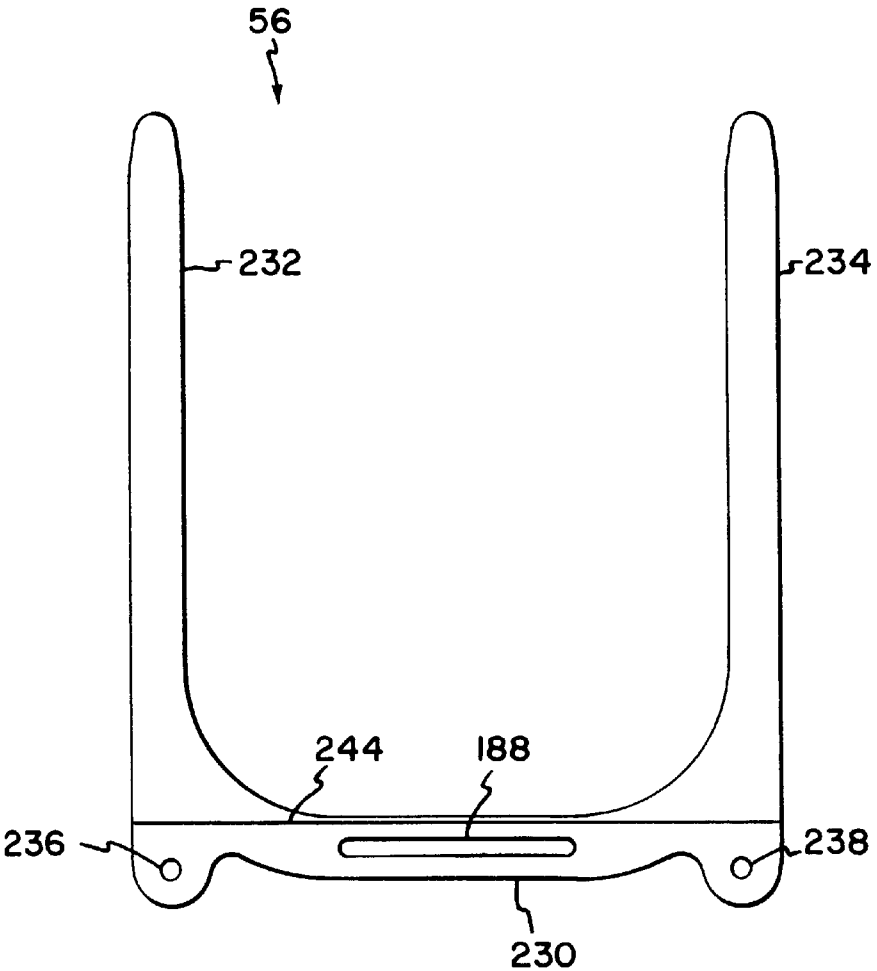
FIG. 5 is a front view of one of the U-shaped members of the rack device of FIG. 1 wherein the line of sight is the same as in FIG. 4.

To facilitate secure mounting of the U-shaped members 50–63, each U-shaped member 50–63 is provided with an interlocking interface, such as a tongue-and-groove interface, between top surface 22 and bottom surface 112 of base 20. For example, as shown in FIGS. 2, 5 and 6, U-shaped member 56 is provided with a tongue 186 for engaging a reciprocally shaped recess in U-shaped member 57, and a groove 188 for engaging a reciprocally shaped tongue on U-shaped member 55. Other interlocking interfaces are possible instead of the preferred configuration shown in FIGS. 2, 5, and 6.

Referring now to FIGS. 5 and 6 in more detail, exemplary U-shaped member 56 includes a base 230 with projecting fingers 232, 234 on opposite sides of base 230. A front of base 230 includes a first ridge 244 which cooperates with a second ridge on a rear of U-shaped member 55 (like ridge 260 on a back of U-shaped member 56 in FIG. 6) to define a bottom of guide slot 75. On a back of U-shaped member 56, ridge 260 cooperates with a ridge on a front of U-shaped member 57 (like ridge 244 on U-shaped member 56 in FIG. 5) to define a bottom of guide slot 76. First top ridge 240 and second top ridge 242 define the upper portion of rivet recesses 88, 90. As shown in FIGS. 1 and 2, the base of each U-shaped member 50–63 securely engages one another, and the guide fingers 24*a*, 26*a* are appropriately spaced apart to define the knife guide slots wherein one guide finger 24*a* of first row 24 is aligned with a guide finger 26*a* of the second row 26 on opposite sides of the top surface 22 to define a guide pair. Two guide pairs form one of guide slots 70–82. During use, the operator aligns the knife 34 between two adjacent guide pairs of fingers 24*a*, 26*a* to effect the slicing of the food item.

In the preferred embodiment, fingers 24*a*, 26*a* and base 20 are formed from separate U-shaped members, 50–63. Alternatively, fingers 24*a*, 26*a* and base 20 of device 10 can be constructed from an integrally formed unit with gaps or slits molded or otherwise provided in portions of the unit to define fingers 24*a*, 26*a*. In addition, fingers 24*a*, 26*a* need not be integrally formed with base 20. For example, fingers 24*a*, 26*a* can each be formed from an integrally formed member with gaps or slits molded or otherwise provided in portions of the members to define fingers 24*a*, 26*a*, with the members further joined or otherwise attached to base 20 to form device 10.

Device 10 includes visual indicators to help the operator properly align knife 30 with the appropriate guide fingers 24*a*, 26*a*. In device 10, even numbered U-shaped members 50–62 are provided with one color, and odd numbered U-shaped members 51–63 are provided with a different color. Such construction helps facilitate ease of alignment of guide slots 70–82 and knife 34 in the successive order during slicing.

Preferably, each U-shaped member is integrally formed from molded plastic provided with a particular colorant. Moreover, ease of manufacture is facilitated since U-shaped members 51, 52 and 54–62 are structurally identical, except for the above noted odd/even variations in color or other indicia.

Preferably, front U-shaped member 50 is provided with an aesthetically pleasing front surface, and appropriate recesses 180 for receiving nut 185 of each bolt 184. Preferably, middle U-shaped member 53 is integrally formed with first and second long legs 92, 94, knife clips 100, 106, and cord clip 114. Preferably, rear U-shaped member 63 is provided with an integrally formed backstop 30 extending from base 20 and each of fingers 24*a*, 26*a* of U-shaped member 63, short legs 96, 98, and appropriate recesses 182 for head 187 of each bolt 184.

Figure 7:
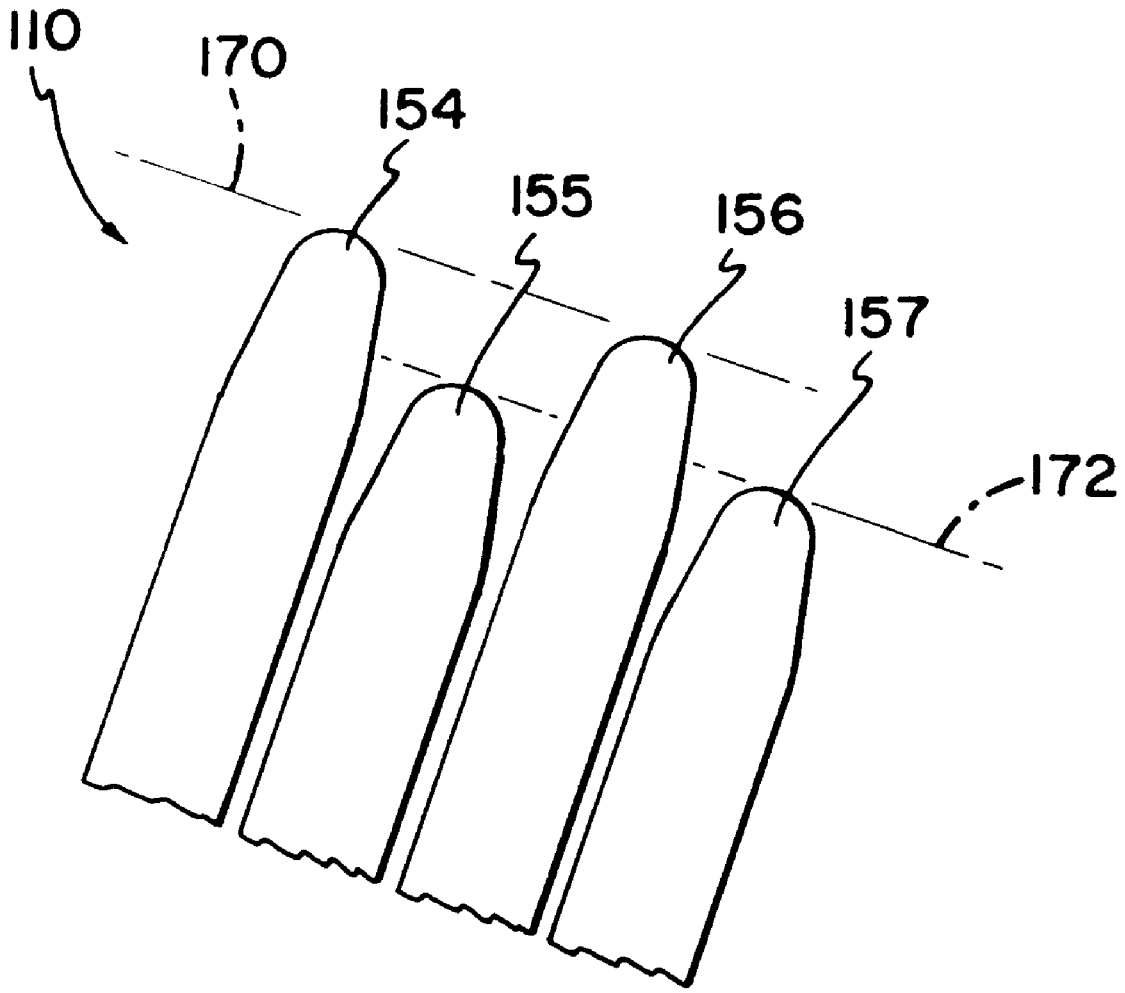
FIG. 7 is an enlarged partial right side elevational view of an alternative rack device including guide fingers having different relative heights.

Other visual indicators besides color can be utilized to identify different guide pairs of fingers 24*a*, 26*a*. Different structural configurations can be used as visual indicators such as shown, for example, in an alternative embodiment of a rack device 110 in FIG. 7. Rack device 110 is constructed similarly as rack device 10 of FIGS. 1–6 except that the tip portions of the U-shaped members are provided with different relative heights. In FIG. 7, only the tip regions of U-shaped members 154–157 are shown. These members 154–157 correspond generally with U-shaped members 54–57 of FIG. 2. The members 154–157 vary in height between lines 170 and 172. The tip regions alternatively vary in relative heights to facilitate alignment of the knife by the operator. Other structural configurations are possible to differentiate between adjacent guide slots 70–82. Also, visual indicators besides different colors and different structural configurations are possible, including indicia such as text. Various combinations of visual indicators may be used if desired (e.g., color and different relative heights).

Referring again to FIGS. 1–6, an example of one method of operating device 10 will be described. If knife 34 is mounted to rack device 10, knife 34 is unsnapped by pulling knife 34 toward the operator and away from rack device 10 in a direction generally parallel to the direction of extension of top surface 22 of base 20, for example. As shown in FIG. 4, loaf of bread 48 is positioned within the cutting chamber between rows 24, 26 of fingers. Preferably, loaf of bread 48 is positioned against backstop 30. The operator identifies a first guide slot 70–83 between adjacent guide pairs of fingers 24*a*, 26*a* for receipt of blades 40, 42 of knife 34. The operator selects an appropriate slot according the thickness of the slice desired by the operator. During cutting, the operator moves knife 34 downwardly toward base 20 in the direction of arrow 280. Upon the completion of the cutting of the slice, the operator draws knife 34 toward the operator in the direction of arrow 284. Rivet 44 passes through the rivet recess present in the guide slot 70–82. At this point, the slice is ready for removal, if desired. If not, the slice remains tilted backwards toward the remainder of the unsliced loaf of bread 48. If the operator desires further a further slice, the operator selects an appropriate guide slot according to the desired thickness of the next slice. Once the operator is finished with the cutting of the loaf of bread 48, the operator removes the appropriate number of slices. The operator can remove the entire amount of cut slices and any remaining portion of bread through the use of hand slot 32 by moving the hand through the slot toward the bread slices in a direction from rear portion 14 to front portion 12 of rack device 10. At the completion of the cutting operation, knife 34 can be mounted to rack device 10 in the manner shown in FIG. 1. It is to be appreciated that body 36 of knife 34 can be mounted to rack device 10 with or without blades 40, 42. Cord 46 is unplugged from the socket and mounted to cord clip 114. In this manner, device 10, and knife 34 can be conveniently stored as a single unit.

From the foregoing detailed description of the present invention, it has been shown how the objects of the invention have been obtained in a preferred manner. However, modifications and equivalents of the disclosed concepts, such as those which would readily occur to one skilled in the art, are intended to be included within the scope of the claims.

What is claimed is:

1. A food slicing rack device comprising:

a base with a top surface and a bottom;

two rows of spaced apart fingers defining knife guide slots extending from the base to top ends, each finger tapered at the top end, the two rows of fingers spaced from each other to receive a food item for slicing on the top surface of the base between the two rows of fingers, the fingers of one row aligned with the fingers of the other row to define guide pairs on opposite sides of the knife guide slots, each guide pair provided with a visual indicator different from a visual indicator of an adjacent pair, a portion of the space between the fingers being sufficiently large to permit electric knife blades and an electric knife blade rivet of an electric knife to pass within the portion, the top surface of the base including grooves aligned with the knife guide slots and extending between the knife guide slots, the base further including raised portions between the grooves;

a backstop integrally formed with two of the fingers adjacent to a first end of each row of fingers, and a second end of each row of fingers defining an open end, the backstop defining a central slot for food removal from the food slicing rack device after slicing, the base, the fingers, and the backstop being constructed of a plastic material; and at least one rubber stop mounted to the bottom of the base.

2. The food slicing rack device of claim 1, wherein the bottom of the base including the at least one rubber stop defines a plane for supporting the base on a horizontal surface, the top surface of the base at an angle relative to the plane, wherein the top surface slopes downwardly in a direction from the open end toward the backstop when the base is positioned on the horizontal surface.

3. A food slicing rack device comprising:

a base with a top surface, the base having a support for supporting the base on a horizontal surface, the support defining a plane parallel to the horizontal surface;

two rows of spaced apart fingers defining knife guide slots extending from the base, the two rows of fingers spaced from each other to receive a food item for slicing on the top surface of the base between the two rows of fingers; and a backstop positioned adjacent to a first end of each row of fingers to define a closed end of the food slicing rack device, a second end of each row of fingers defining an open end of the food slicing rack device, the top surface of the base at an angle relative to the plane defined by the support of the base, wherein the top surface of the base slopes downwardly in a direction from the open end toward the closed end when the support of the food slicing rack device is positioned on a horizontal surface.

4. The food slicing rack device of claim 3, wherein a plurality of the fingers of each row include an electric knife rivet recess adjacent to an end of the respective fingers near the base, wherein a distance between two adjacent fingers in the same row is greater at the electric knife rivet recess relative to a distance between the two adjacent fingers at a region disposed away from the electric knife rivet recess.

5. The food slicing rack device of claim 4, further comprising a knife clip extending from the base sized for snap fittingly receiving a body of an electric knife between the clip and the base.

6. The food slicing rack device of claim 3, wherein the fingers of one row are aligned with the fingers of the other row to define guide pairs, each guide pair comprising one finger from each row, with guide pairs being disposed on opposite sides of each knife guide slot, each finger of each guide pair being provided with a visual indicator different from a visual indicator of an adjacent guide pair, each finger of each guide pair having the same visual indicator.

7. The food slicing rack device of claim 6, wherein the visual indicators include different colors associated with each guide pair relative to the adjacent guide pair.

8. The food slicing rack of claim 6, wherein the visual indicators include different relative heights for each guide pair relative to the adjacent guide pair, wherein each guide pair has an alternating height relative to the adjacent guide pair relative to the top surface of the base, wherein the heights of the guide pairs alternate so that every other guide is of equal height relative to the top surface of the base.

9. The food slicing rack device of claim 6, wherein the base and the two rows of spaced apart fingers are constructed from a plurality of separate U-shaped members with an aperture through each member, and a rod member positioned in the aperture of each member to join the U-shaped members together.

10. The food slicing rack device of claim 9, wherein the U-shaped members comprise plastic wherein adjacent U-shaped members are provided with a different color.

11. The food slicing rack device of claim 9, further comprising an interlock arrangement between each adjacent U-shaped member.

12. The food slicing rack device of claim 9, wherein a first of the U-shaped members adjacent to the open end includes two supporting legs, and a second of the U-shaped members adjacent to the backstop includes two supporting legs, wherein the supporting legs on the first U-shaped member are longer than the supporting legs of the second U-shaped member.

13. The food slicing rack device of claim 12, wherein the first U-shaped member includes a knife clip and a cord clip.

14. The food slicing rack device of claim 3, wherein the backstop defines a three-sided central slot for food removal from the food slicing rack device after slicing.

15. The food slicing rack device of claim 3, further comprising a knife clip extending from the base sized for snap fittingly holding a handle of a knife between the clip and the base.

16. The food slicing rack device of claim 15, further comprising a cord clip extending from the base.

17. The food slicing rack of claim 3, wherein the base and the two rows of spaced apart fingers are constructed from a plurality of separate U-shaped members with an aperture through each member, and a rod member positioned in the aperture of each member to join the U-shaped members together, and further comprising an interlock arrangement between each adjacent U-shaped member.

18. A bread slicing rack device for slicing a loaf of bread having a bottom and an end comprising:

a base with a top surface for supporting the bottom of the loaf of bread;

two rows of spaced apart fingers defining knife guide slots extending from the base, the two rows of fingers spaced from each other to receive the loaf of bread for slicing on the top surface of the base between the two rows of fingers, each row of fingers having two ends, wherein the fingers are spaced apart a sufficient distance to permit electric knife blades of an electric knife to pass within the space between adjacent fingers, wherein at least a portion of the space between the fingers is sufficiently large to permit the electric knife blades and an electric knife blade rivet of the electric knife to pass within the portion; and a backstop having two sides, each side interconnected to an end finger at one end of each row of fingers, the backstop further having a bottom member interconnected to the base, wherein the backstop supports the loaf of bread on three sides of the end of the loaf of bread, and wherein the backstop further defines a central slot for bread removal from the bread slicing rack device after slicing.

19. The bread slicing rack device of claim 18, further comprising:

a loaf of bread positioned on the top surface of the base between the two rows of fingers, the loaf of bread further positioned adjacent to the backstop, the loaf of bread having a height relative to the top surface of the base, the fingers and the sides of the backstop each having a top portion each of which is positioned at a height from the top surface of the base greater than the height of the loaf of bread, the central slot extending from the top portions of the sides of the backstop to a lowermost portion defined by a top portion of the bottom member, the lowermost portion of the central slot positioned below the top surface of the loaf of bread, and also above the top surface of the base, whereby the sides and the bottom member of the backstop support the loaf of bread on three sides of the end of the loaf of bread.

20. The bread slicing rack device of claim 18, wherein the sides and the bottom member of the backstop form an integral, one-piece U-shaped backstop.

21. The bread slicing rack device of claim 18, wherein the top surface of the base includes grooves aligned with the knife guide slots and extending between the knife guide slots, the base further including raised portions between the grooves.

22. A bread slicing rack device for slicing a loaf of bread having a bottom and an end comprising:

a base with a top surface for supporting the bottom of the loaf of bread;

two rows of spaced apart fingers defining knife guide slots extending from the base, the two rows of fingers spaced from each other to receive the loaf of bread for slicing on the top surface of the base between the two rows of fingers, each row of fingers having two ends, the top surface of the base including grooves aligned with the knife guide slots and extending between the knife guide slots, the base further including raised portions between the grooves;

a backstop having two sides, each side projecting inwardly from an end finger at one end of each row of fingers, the backstop further having a bottom member projecting upwardly relative to the base, wherein the backstop restricts the movement of the loaf of bread on three sides of the end of the loaf of bread when the loaf of bread is in a slicing position, and wherein the backstop further defines a central slot for bread removal from the bread slicing rack device after slicing.

* * * * *